US007469895B2

(12) United States Patent
Aoki et al.

(10) Patent No.: US 7,469,895 B2
(45) Date of Patent: Dec. 30, 2008

(54) DOCUMENT FEEDING APPARATUS AND IMAGE READING APPARATUS

(75) Inventors: Masashi Aoki, Hachioji (JP); Tsuyoshi Mizubata, Hachioji (JP); Satoru Shimizu, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 495 days.

(21) Appl. No.: 11/221,857

(22) Filed: Sep. 9, 2005

(65) Prior Publication Data

US 2006/0180978 A1 Aug. 17, 2006

(30) Foreign Application Priority Data

Dec. 22, 2004 (JP) ..... 2004-370873

(51) Int. Cl.
*B65H 7/02* (2006.01)

(52) U.S. Cl. ..... 271/265.02; 271/265.03

(58) Field of Classification Search ..... 271/265.02, 271/265.03

See application file for complete search history.

(56) References Cited

U.S. PATENT DOCUMENTS 5,918,877 A * 7/1999 Takei et al. ..... 271/261
5,946,527 A * 8/1999 Salgado et al. ..... 399/82
6,145,834 A * 11/2000 Hirota et al. ..... 271/225
6,151,478 A * 11/2000 Katsuta et al. ..... 399/372
6,185,381 B1 * 2/2001 Nakahara et al. ..... 399/21
6,256,119 B1 * 7/2001 Isozaki ..... 358/498
6,313,928 B1 * 11/2001 Yu ..... 358/488
6,321,064 B1 * 11/2001 Mizubata et al. ..... 399/370
6,859,637 B2 * 2/2005 Kawai ..... 399/367
7,308,853 B2 * 12/2007 Satoh et al. ..... 101/118
2004/0062580 A1 * 4/2004 Kawai ..... 399/367

* cited by examiner

*Primary Examiner*—Patrick H Mackey
*Assistant Examiner*—Prasad V Gokhale
(74) *Attorney, Agent, or Firm*—Finnegan, Henderson, Farabow, Garrett & Dunner, L.L.P.

(57) ABSTRACT

There is described a document feeding apparatus and an image reading apparatus, which are employed for a copier, a facsimile, a scanner, etc. The document feeding apparatus or the image reading apparatus includes: a document feeding tray on which documents are stacked; a paper forwarding device to forward the documents; a document detector to detect the documents; and a controller to control the paper forwarding device. When forwarding a document having a length equal to or greater than a predetermined length in a conveying direction, the controller activates the paper forwarding device so as to forward a next document based on a detected result acquired by the document detector. While, when forwarding a document having a length smaller than the predetermined length, the controller activates the paper forwarding device so as to forward a next document without being based on a detected result acquired by the document detector.

9 Claims, 4 Drawing Sheets

DOCUMENT FEEDING APPARATUS AND IMAGE READING APPARATUS

This application is based on Japanese Patent Application NO. 2004-370873 filed on Dec. 22, 2004 in Japanese Patent Office, the entire content of which is hereby incorporated by reference.

BACKGROUND OF THE INVENTION

The present invention relates to a document feeding apparatus and an image reading apparatus, which are employed for a copier, a facsimile, a scanner, etc.

Referring to FIG. 1, operations performed in the conventional document feeding apparatus will be detailed in the following. Incidentally, although FIG. 1 shows a mechanical configuration of the document feeding apparatus embodied in the present invention, contents of operations to be performed in the document feeding apparatus of the present invention are different from those performed in the conventional document feeding apparatus, as described later.

As shown in FIG. 1, a forwarding roller 2 forwards documents D stacked on a document feeding tray 1, and a document feeding roller 4 separates the documents D to feed a single sheet of the documents D. After the separated single sheet of the documents D is temporally stopped at a registration roller 6, the sheet of documents D passes through a document reading position 7 while being conveyed by the registration roller 6, and finally is ejected onto an ejecting tray 8.

In the forwarding operation performed by the forwarding roller 2, a document pushing plate 3 elevates upward to push the documents D against the forwarding roller 2. Further, at a separating position where a single document is separated from the documents D, the document feeding roller 4 rotates while press-contacting a separating roller 5 so as to separate the single document from the documents D.

In a continuous conveying operation for continuously conveying a plural sheets of documents D, the forwarding roller 2, the document pushing plate 3, the document feeding roller 4 and the registration roller 6 are not continuously operated, but are intermittently operated in repetitions between activation and deactivation for every feeding operation of a single sheet of the documents D (hereinafter, the term of "document D" represents a single sheet of documents D, while the term of "documents D" represents a plurality of documents as one group).

Concretely speaking, the rotation of the forwarding roller 2, the elevation of the document pushing plate 3 and the rotation of the document feeding roller 4 are activated substantially at a same time to forward the document D. Then, after a short time period has passed since the leading edge of the document D detected by the sensor S4 disposed immediately in front of the registration roller 6, the forwarding roller 2 and the document feeding roller 4 are deactivated, and, after a loop of the document D is formed between the document feeding roller 4 and the registration roller 6, the registration roller 6 is activated to convey the document D. At the same time when the forwarding roller 2 and the document feeding roller 4 are deactivated, the document pushing plate 3 is activated to descend. The driving action of the registration roller 6 is deactivated after a predetermined time period has passed, and, after its driving action is deactivated, the registration roller 6 is driven by the passing action of the document D to rotate. While the registration roller 6 is activated, the forwarding roller 2 and the document feeding roller 4 are idle running due to an action of a one-way clutch mechanism.

The abovementioned operations performed between the forwarding roller 2 and the registration roller 6 are repeated for every document D. Further, the activating timing of the forwarding roller 2, the document pushing plate 3 and the document feeding roller 4 is set at a time interval determined in advance corresponding to a document size. Incidentally, information in regard to the document size are acquired, based on the detection results detected by document sensors S1-S3 mounted on the document feeding tray 1 and a document width detector (not shown in the drawings), which detects positions of the regulating members for regulating the position of the document D in the width direction.

In such the operation for controlling the document feeding apparatus, the deactivation control, for prohibiting the feeding action after detecting the final document by detecting a final single sheet of documents D residing on the document feeding tray 1, is conducted on the basis of the document absence detection signals detected by the document sensors S1-S3 serving as a document detector. The document absence detecting operation to be performed by document sensors S1-S3 is achieved in such a manner that the document sensors S1-S3 detect the fact that none of documents D reside on upper side of the document sensors S1-S3. This is achieved when the trailing edge of the final document D passes through any one of the document sensors S1-S3, which is detecting the trailing edge of the final document D at a position being farthest from the forwarding roller 2.

Patent Document 1 sets forth a configuration in which a plurality of document detectors are provided so as to select and use one of the plurality of document detectors. According to the invention set forth in Patent Document 1, the final document detecting operation is surely performed in the small-sized document feeding apparatus.

[Patent Document 1]

Japanese Patent No.3404708

In such the document conveyance controlling operation, the final document D is forwarded after the final document D is detected. Incidentally, although the final document D is detected by the document sensors S1-S3 mounted on the document feeding tray 1, it is impossible for the document sensors S1-S3 to detect the final document D when the documents D are small-sized to such a extent that the document sensors S1-S3 cannot detect. Accordingly, when detecting the final document D of such the small-sized documents D, a document sensor S5 disposed at a position near the forwarding roller 2 is employed for detecting whether or not the document D resides on the document feeding tray 1.

Each of the document sensors S1-S3 is disposed at such a position that is located in the vicinity of a trailing edge of the documents D of each size. Accordingly, any one of document sensors S1-S3 can detect the absence of the next document D just after the final document D started to be fed.

However, the document sensor S5 is not disposed at a position in the vicinity of a trailing edge of the documents D, but at a position near the forwarding roller 2. Accordingly, since it takes some time that the trailing edge of the final document D arrives at the position of the document sensor S5 after the final document D starts to be fed, the detection timing of the final document D to be detected by the document sensor S5 would be delayed.

In the document continuously-conveying mode in which a plurality of documents D are sequentially conveyed one by one, each of documents D is forwarded after confirming that a document D preceding to another document D to be currently forwarded is not the final document D. Therefore, the abovementioned delay of the timing for detecting the final document D causes another delay of the timing for confirming that the current document D is not the final one, resulting in an increase of a time interval for feeding each of the documents D (hereinafter, referred to as a document interval, for simplicity) in the document continuously-conveying mode.

Basically, the document interval in the document continuously-conveying mode is established by considering the relationship with the image reading velocity and the prevention of the jam caused by collisions between documents conveyed before and after, so that the reading efficiency is designed to be raised by shortening the document interval as short as possible. However, due to the aforementioned specific circumstances in the case of the small-sized documents D, there has been a problem for the small-sized documents D that the reading efficiency is lowered since the document interval becomes long.

In the image forming apparatus equipped with the document feeding apparatus, such as a copier, the smaller the image size becomes, the shorter the image forming interval should be, so as to efficiently perform the image forming operation. Accordingly, in the document feeding apparatus, the deterioration of the conveying efficiency in the case of the small-sized documents D causes a mismatch with the image forming efficiency in the image forming section, and therefore, the abovementioned problem becomes a practical obstacle.

Concretely speaking, despite that the image forming section has a capability of forming image in a higher efficient mode, the image forming section is obliged to lower the image forming efficiency so as to match it with the deterioration of the conveying efficiency.

SUMMARY OF THE INVENTION (1) A document feeding apparatus, comprising:

a document feeding tray on which documents are stacked;

a paper forwarding device to forward the documents stacked on the document feeding tray;

a document detector to detect the documents stacked on the document feeding tray; and a controller to control the paper forwarding device;

wherein, when forwarding a document having a length equal to or greater than a predetermined length in a conveying direction, the controller activates the paper forwarding device so as to forward a next document based on a detected result acquired by the document detector; and wherein, when forwarding a document having a length smaller than the predetermined length in the conveying direction, the controller activates the paper forwarding device so as to forward a next document without being based on a detected result acquired by the document detector.

(2) An image reading apparatus, comprising:

a document feeding tray on which documents are stacked;

a paper forwarding device to forward the documents stacked on the document feeding tray;

a document detector to detect the documents stacked on the document feeding tray; and a controller to control the paper forwarding device;

wherein, when forwarding a document having a length equal to or greater than a predetermined length in a conveying direction, the controller activates the paper forwarding device so as to forward a next document based on a detected result acquired by the document detector; and wherein, when forwarding a document having a length smaller than the predetermined length in the conveying direction, the controller activates the paper forwarding device so as to forward a next document without being based on a detected result acquired by the document detector.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
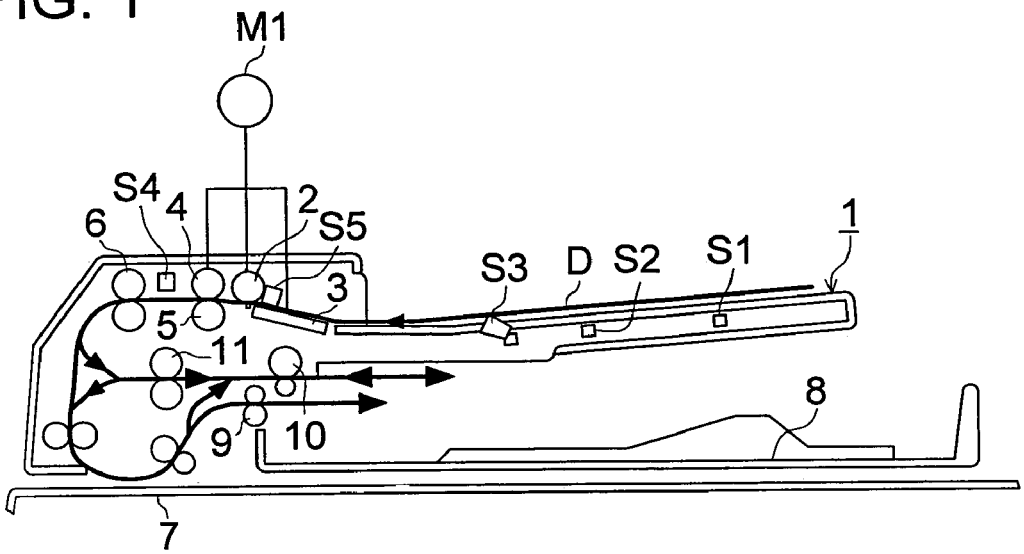
FIG. 1 shows a document feeding apparatus embodied in the present invention.

Referring to the drawings, an image-forming apparatus, embodied in the present invention, will be detailed in the following. The scope of the present invention, however, is not limited to the embodiment shown in the drawings.

FIG. 1 shows a document feeding apparatus embodied in the present invention.

Numeral 1 indicates a document feeding tray on which a plurality of documents D are stacked (hereinafter, the term of "document D" represents a single sheet of a plurality of documents D, while the term of "documents D" represents a plurality of documents as one group). The forwarding roller 2, serving as a forwarding member, forwards the plurality of documents D one by one from the upper-most sheet to the lower-most sheet. The document pushing plate 3, serving as a document pushing member, pushes the documents D against the forwarding roller 2. By the combined action of the document feeding roller 4 and the separating roller 5, the document D is separated from the documents D forwarded by the forwarding roller 2. Numeral 6 indicates a registration roller, at which the leading edge of the document D is temporally stopped so as to form a loop of the document D in the upstream side of the registration roller 6. Then, the registration roller 6 conveys the document D toward the document reading position 7 after truing the attitude of the document D.

A paper forwarding device includes the forwarding roller 2, the document pushing plate 3 and the document feeding roller 4.

The separating roller 5 serves as a stopping roller with a torque limiter. The document D, defined as a single sheet, is separated from the documents D between the document feeding roller 4 rotating in a conveying direction and the separating roller 5. The forwarding roller 2, the document pushing plate 3 and the document feeding roller 4 are driven and operated by a common motor M1 so as to repeat activations and deactivations of them for every document D. Further, the document pushing plate 3 performs elevating and descending actions. The elevating action and the descending action are activated by the forward rotation and the reverse rotation of motor M1, respectively. Still further, the forwarding roller 2 and the document feeding roller 4 are coupled to motor M1 through a one way clutch. Accordingly, when the document pushing plate 3 is elevating, both of them are rotated by the driving action of the motor M1, while, when the document pushing plate 3 is descending, both of them are driven to rotate by the moving action of the documents D due to the friction generated between the document D and them.

The document feeding apparatus shown in FIG. 1 can be operated in either a first conveying mode for reading only one side of the document D or a second conveying mode for reading both sides of the document D.

In the first conveying mode for reading only one side of the document D, the document D, conveyed by the registration roller 6 and passing through the document reading position 7, is ejected onto the ejecting tray 8 by an ejecting roller 9. The reading operation of the document D is conducted at the time when the document D passes through the document reading position 7.

In the second conveying mode for reading both sides of the document D, the document D, conveyed by the registration roller 6, progresses toward a reverse rotation roller 10, and switch-backed by the reverse rotation roller 10. Then, the document D passes an intermediate roller 11 and further passes through the document reading position 7 and again progresses toward a reverse rotation roller 10. Then, the document D is again switch-backed by the reverse rotation roller 10 so that the intermediate roller 11 again conveys the document D toward the document reading position 7. After the document D passes through the document reading position 7, the ejecting roller 9 ejects the document D onto the ejecting tray 8. The reverse side of the document D is read at the time when the document D initially passes through the document reading position 7, while the obverse side of the document D is read at the time when the document D again passes through the document reading position 7.

Figure 2:
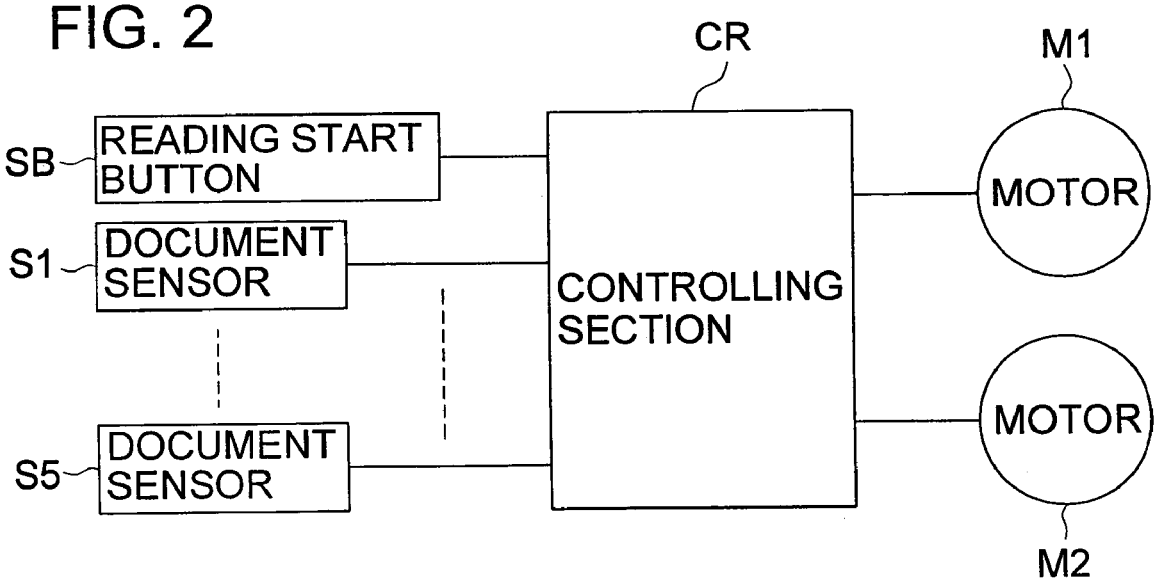
FIG. 2 shows a block diagram of a control system employed in the document feeding apparatus embodied in the present invention.

FIG. 2 shows a block diagram of a control system employed in the document feeding apparatus embodied in the present invention.

Based on command signal sent from a reading start button SB, a controlling section CR such as a controller activates the motor M1 and a motor M2 to convey the document D. Then, based on the detected signals sent from the document sensors S1-S5, controlling section CR conducts the conveyance controlling operation detailed in the following.

Further, a document size is detected by the document sensors S1-S3, serving as size detecting sensors equipped in the document detector, and a document width detector for detecting positions of regulating members to regulate a position of the document D in its width direction (not shown in the drawings). When all of the document sensors S1-S3 are turned ON, the controlling section CR determines that the documents D having a maximum length in its conveyance direction are stacked on the document feeding tray 1. When the document sensor S1 is turned OFF while document sensors S2, S3 are turned ON, the controlling section CR determines that the documents D having a secondary length in its conveyance direction are stacked on the document feeding tray 1. Further, when the document sensor S5 is turned ON despite that all of the document sensors S1-S3 are turned OFF, the controlling section CR determines that the size of the documents D is smaller than the predetermined minimum size, namely, the length of the documents D in its conveyance direction is shorter than the predetermined value.

Incidentally, although the controlling section CR conducts the document size detecting operation in the present embodiment, it is also applicable to configure the system in such a manner that a main controlling section, provided in an apparatus proper, such as image reading apparatus, a copier, etc., which is equipped with the document feeding apparatus, conducts the document size detecting operation based on the results detected by the document sensors S1-S3, and the controlling section CR acquires the information in respect to the document size from the main controlling section. Further, it is also applicable that the main controlling section directly controls the operations of the members of the document feeding apparatus, such as the forwarding roller 2, etc., based on the information in respect to the document size.

Figure 3:
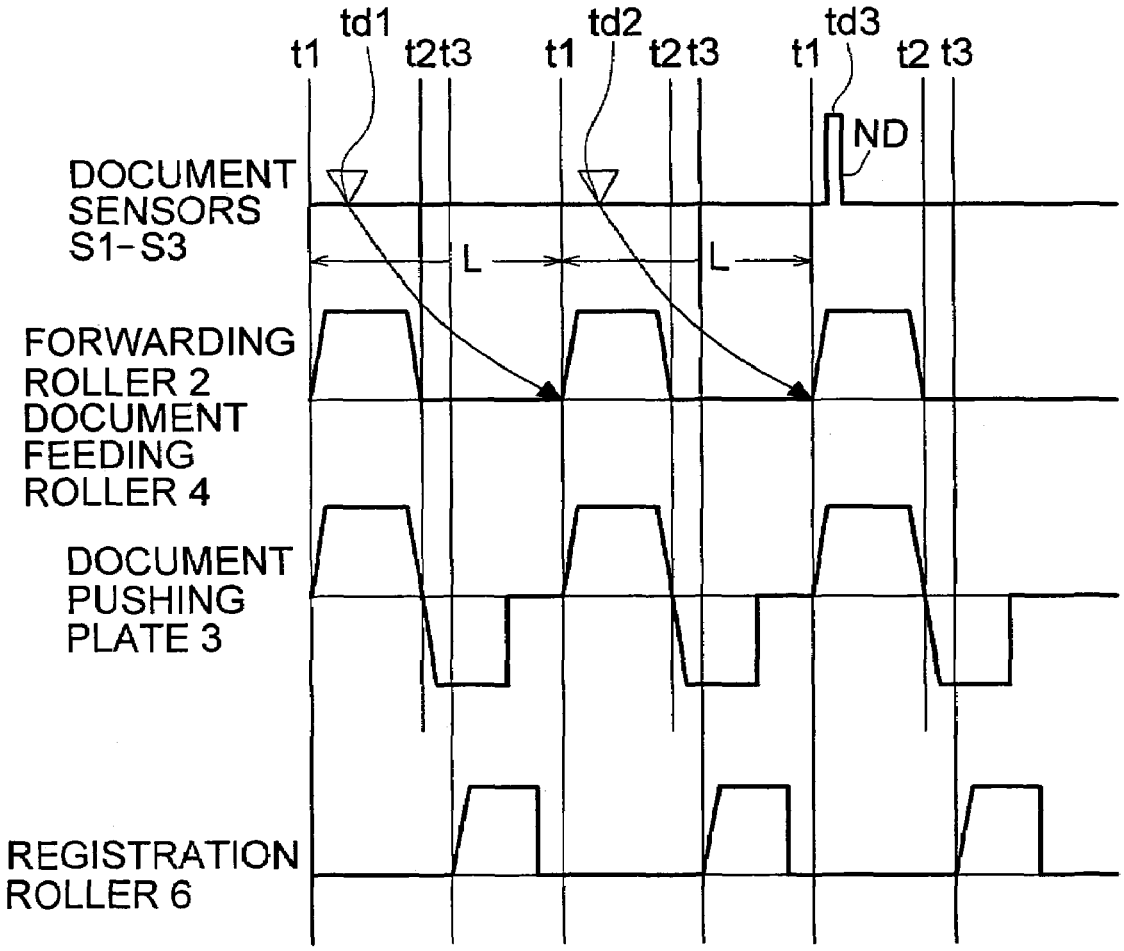
FIG. 3 shows a timing chart of the operations of various sections of the paper feeding section in the continuous document conveying mode.

FIG. 3 shows a timing chart of the operations of various sections of the paper feeding section in the continuous document conveying mode. Indicated in FIG. 3 is an exemplified case of continuously conveying the documents D including three documents having a length in its conveying direction, which can be detected by the document sensors S1-S3.

In the present embodiment, the document sensors S1-S3 are provided so as to detect the document D having a size up to A4 size and placing a short side in its conveying direction can be detected (for instance, the document D having a length equal to or longer than 210 mm in its conveying direction).

FIG. 3 shows the operating timings of various sections of the paper feeding section, when the operation for detecting absence or presence of the document D is conducted by using the document sensors S1-S3, namely, the size of the document D is detectable for the document sensors S1-S3. While, FIG. 4 shows the operating timings of various sections of the paper feeding section, when the size of the document D in its conveying direction is not detectable for the document sensors S1-S3.

Figure 4:
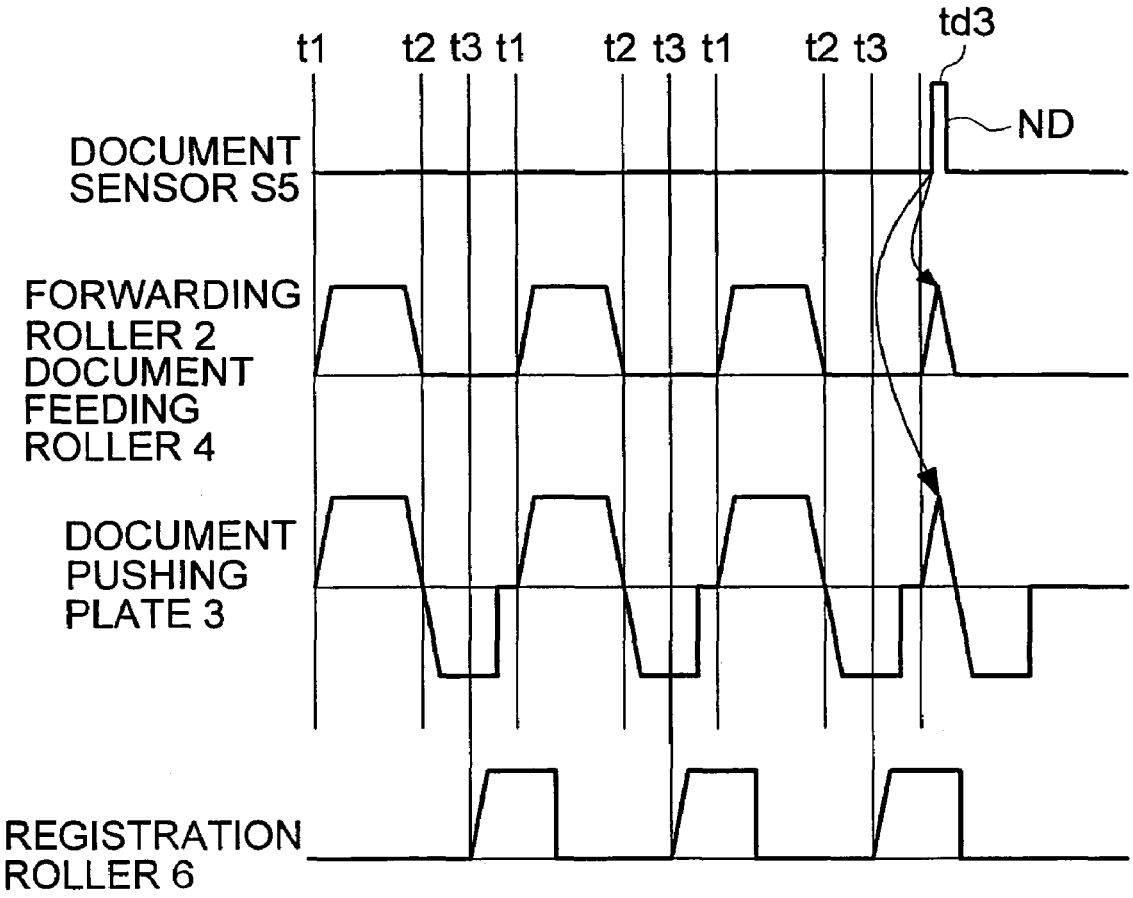
FIG. 4 shows the operating timings of various sections of the paper feeding section, when conveying a small-sized document.

In FIG. 4, the operation for detecting absence or presence of the document D is conducted by using the document sensor S5, serving as a document absence-or-presence detecting sensor.

At first, referring to FIG. 3, the document forwarding operation will be detailed in the following.

Based on command signal sent from the reading start button SB, the forwarding roller 2 and the document pushing plate 3 and the document feeding roller 4 are activated at time t1. As aforementioned, since the forwarding roller 2 and the document pushing plate 3 and the document feeding roller 4 are driven by the common motor M1, these are activated at the same time t1.

At the time when the document pushing plate 3 reaches to the upper limit position, the document pushing plate 3 stops elevating and the document D is forwarded. Then, at time t2, the rotating direction of the motor M1 is reversed, and the document pushing plate 3 descends, and then, stops at a time when the document pushing plate 3 arrives at the lower limit position.

After the forwarding roller 2 and the document feeding roller 4 are stopped at the time when the leading edge of the document D reaches to the registration roller 6 and a loop of the leading portion of the document D is formed at the upstream side of the registration roller 6, the registration roller 6 is activated by the driving action of the motor M2 at time t3, so as to convey the document D toward the document reading position 7.

Although the consecutive operations mentioned in the above are repeated for each of the documents D, the document interval L, defined as a time interval between a certain time t1 and a next time t1, is established at such a time interval that corresponds to the document size, which is detected by the document sensors S1-S3.

Although the forwarding operation for the first document of the documents D is activated on the basis of the reading command, the forwarding operation for the second document or the third document is activated after confirming that the next document D is still residing on the document feeding tray 1 in the time interval from a start of the conveyance operation of the preceding document D to a time when document interval L has elapsed. This confirming operation is achieved when the trailing edge of the document D passes through any one of the document sensors S1-S3. Since each of the document sensors S1-S3 is disposed at the vicinity of the trailing edge of the document D corresponding to each of the various document sizes, as shown in FIG. 3, the operation for detecting absence or presence of the next document D is conducted at time td1, time td2 and time td3, which are just after the start of the conveyance operation of the preceding document D. Until the final document D passes through, a signal indicating absence of the document D is not outputted, since the document D is residing on at least any one of the document sensors S1-S3 corresponding to the various document sizes. The signal indicating absence of the document D (hereinafter, referred to as absence signal ND) is outputted at time td3 when the trailing edge of the document D passes through any one of the document sensors S1-S3, on which the trailing edge of the document D resides.

In the example shown in the drawing, as indicated by the arrow, the operation for determining whether or not the second document D should be conveyed, is conducted on the basis of a result of detecting absence or presence of the next document D at time td1 when the trailing edge of the first document D passes through any one of the document sensors S1-S3, on which the trailing edge of the first document D resides. Successively, the operation for determining whether or not the third document D should be conveyed, is conducted on the basis of a result of detecting absence or presence of the next document D at time td2 when the trailing edge of the second document D passes through any one of the document sensors S1-S3, on which the trailing edge of the second document D resides. Since the absence signal ND is not outputted at time td1 and time td2, an implementation of the paper feeding operation is determined and implemented.

At a time when the trailing edge of the third document D passes through any one of the document sensors S1-S3, on which the trailing edge of the third document D resides, non of the next document D reside on the document feeding tray 1. Accordingly, the document sensors S1-S3 output the absence signal ND at time td3 and, based on the absence signal ND, the conveying operation of the next document D is disabled.

Next, referring to FIG. 4, the forwarding operation of the document D will be detailed in the following.

Based on the reading start signal inputted from the reading start button SB, the motor M1 is activated at time t1 to drive the forwarding roller 2, the document pushing plate 3 and the document feeding roller 4 so that the document conveying operation is commenced.

At time t2, the rotating direction of the motor M1 is reversed, and the document pushing plate 3 descends. Then, at time t3, the registration roller 6 is activated by the driving action of the motor M2 so as to convey the document D towards the document reading position 7.

Due to the repetitions of the abovementioned operations conducted during the time interval from time t1 to t3, the three documents D are conveyed. Even in the example shown in FIG. 4, the document sensor S5 does not output the absence signal ND as far as the next document D still resides on the document feeding tray 1, but outputs the absence signal ND at td3 when the trailing edge of the final document D passes through.

Since the trailing edge of the small-sized document D is detected by the document sensor S5 disposed at the vicinity of the forwarding roller 2, an absence of the document D is detected at time td3 after the third document D is forwarded and the conveying operation of the third document D is commenced by the registration roller 6. Accordingly, if the conveying operation of each of the documents D is commenced after the confirming operation to be conducted at the time of detecting the trailing edge of the third document D as described referring to FIG. 3, the document interval L becomes long.

Figure 5:
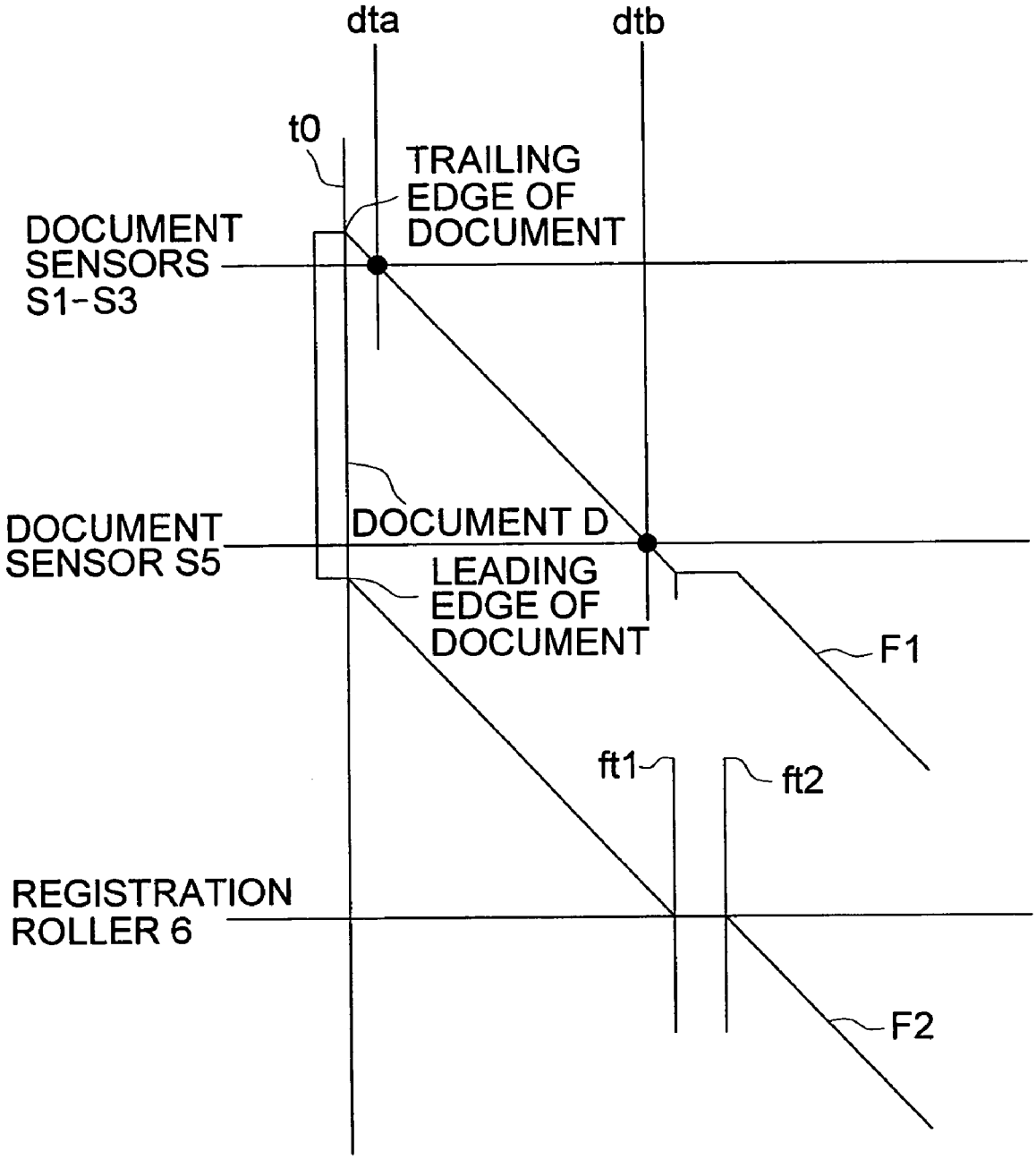
FIG. 5 shows a timing of detecting the trailing edge of the document by means of document sensors.

Referring to FIG. 5, such the delay of the document absence-or-presence detection timing will be detailed in the following. FIG. 5 shows a timing of detecting the trailing edge of the document D by means of the document sensors S1-S3 and another timing of detecting the trailing edge of the document D by means of the document sensor S5. In FIG. 5, the vertical axis indicates a traveling distance of the document D along the document conveying path, while the horizontal axis indicates a time.

Line F1 represents the locus of the trailing edge of the document D, while line F2 represents the locus of the leading edge of the document D.

At time t0, the document D starts traveling. Then, at time dta just after the starting time, the trailing edge of the document D is detected by any one of the document sensors S1-S3, on which the trailing edge of the document D resides.

At time ft1 when the leading edge of the document D is reached to the registration roller 6, the document D is temporarily stopped, and then, at time ft2, restarted by the conveying action of the registration roller 6 so as to convey it towards the-document reading position 7.

The document sensor S5 detects the trailing edge of the document D at time dtb just before the leading edge of the document D reaches the registration roller 6.

As mentioned in the above, the delay time of the timing of detecting the trailing edge of the document D by means of the document sensor S5 is equivalent to the time interval from the time when the trailing edge of the document D is detected by the document sensors S1-S3 to the time when substantially one document D passes through.

To avoid a deterioration of the reading efficiency due to a long document interval L caused by the delay of the detecting timing of the trailing edge of the document D, in FIG. 4, the document conveying operation is commenced without conducting the confirming operation. Concretely speaking, the commencement of conveying the second document D and the commencement of conveying the third document D are determined at the time when the document interval L has elapsed, on the basis of the elapsed information of the document interval L, and then, are implemented.

Successively, at time td3 after the actions of the forwarding roller 2, the document feeding roller 4 and the document pushing plate 3 are commenced by activating the motor M1 after the third document D is conveyed out, the document sensor S5 output the absence signal ND. Then, based on the absence signal ND outputted by the document sensor S5, the forwarding rotation of the motor M1 is deactivated to stop the actions of the forwarding roller 2, the document feeding roller 4 and the document pushing plate 3, as shown by the arrows in FIG. 4. After the forwarding rotation of the motor M1 is deactivated, the motor M1 is activated to rotate in the reverse direction so that the document pushing plate 3 descends, and then, the paper feeding operation is finalized.

It is desirable that the elevation stopping action and the successive descending action of the document pushing plate 3 based on the absence signal ND are as swift as possible. In other words, since the registration roller 6 still conveys the document D even after the motor M1 is deactivated, the forwarding roller 2 contacting the document D is driven to rotate by the document D due to a friction between them. Since the surface of the forwarding roller 2 is finished as a tongued and grooved face, noises are generated when the forwarding roller 2 rotates in a state that the document pushing plate 3 is pres-contacting the forwarding roller 2. To prevent the forwarding roller 2 form generating the noises, it is desirable that the rotating time period of the forwarding roller 2 is made to be short in a state that the document pushing plate 3 and the forwarding roller 2 directly contact each other. For this purpose, it is desirable that the absence signal ND is outputted as early as possible. In the example shown in the drawings, since the document sensor S5 is disposed at the vicinity of the forwarding roller 2, the absence signal ND can be detected before the document pushing plate 3 contacts the forwarding roller 2. Accordingly, the document pushing plate 3 does not directly contact the forwarding roller 2, and the absence signal ND is outputted early.

According to the present embodiment, it becomes possible to solve the problem that the reading efficiency of the document D having a length smaller than a predetermined length is deteriorated due to the fact that its document interval is getting longer. Accordingly, it also becomes possible to provide a document feeding apparatus, which conducts the document conveying operation at a high efficiency irrespective of the document sizes.

According to the present embodiment, since the document size is detected by the document feeding apparatus, the document conveying operation is automatically conducted and it becomes possible to provide a document feeding apparatus being easy for use.

According to the present embodiment, since the operations in the continuous document conveying mode from the commencement of the conveyance to the finalization of the conveyance are conducted automatically even for the small-sized documents, it becomes possible to provide a document feeding apparatus, which conducts the document conveying operation at a high efficiency and is easy for use.

According to the present embodiment, noises to be generated by the rotating action of the forwarding member in a state that the document pushing member directly contact the forwarding member are preferably suppressed.

While the preferred embodiments of the present invention have been described using specific term, such description is for illustrative purpose only, and it is to be understood that changes and variations may be made without departing from the spirit and scope of the appended claims.

What is claimed is:

1. A document feeding apparatus, comprising:

a document feeding tray to stack documents thereon;

a paper forwarding device to sequentially forward each of the documents one by one, in a conveying direction of the documents;

a document detector to detect a presence or absence of each of the documents stacked on the document feeding tray and a length of the documents in the conveying direction of the documents; and a controller to control the paper forwarding device;

wherein when determining that the length of the documents is equal to or greater than a predetermined length in the conveying direction of the documents, the controller controls the paper forwarding device so that the paper forwarding device starts an operation for feeding a next document after the controller has confirmed a fact that the document detector detected a presence of the next document on the document feeding tray; and wherein when determining that the length of the documents is smaller than the predetermined length, the controller controls the paper forwarding device so that the paper forwarding device starts the operation for feeding the next document before the controller confirms the fact that the document detector detects the presence of the next document on the document feeding tray.

2. The document feeding apparatus of claim 1, further comprising:

a regulating member that is movable to regulate a position of the documents, stacked on the document feeding tray, in a direction being orthogonal to the conveying direction; and a document width detector to detect a position of the regulating member;

wherein the controller obtains size information of the document, stacked on the document feeding tray, based on detected results acquired by both the document detector and the document width detector.

3. The document feeding apparatus of claim 1, wherein the paper forwarding device includes:

a forwarding member to forward each of the documents stacked on the document feeding tray in a forwarding direction; and a document pushing member that is movable to push the documents, stacked on the document feeding tray, against the forwarding member.

4. The document feeding apparatus of claim 1, wherein the document detector includes a plurality of sensors one of which is a document absence-or-presence sensor to detect the absence or presence of each of the documents on the document feeding tray; and wherein during an operation for sequentially forwarding each of the documents, the length of which are smaller than the predetermined length, one by one, the controller controls the paper forwarding device so that the paper forwarding device finalizes the operation for feeding the next document when the document absence-or-presence sensor detects the absence of the next document on the document feeding tray.

5. The document feeding apparatus of claim 4, wherein the paper forwarding device includes:

a forwarding member to forward each of the documents stacked on the document feeding tray in a forwarding direction; and a document pushing member that is movable to push the documents, stacked on the document feeding tray, against the forwarding member; and wherein the document absence-or-presence sensor is disposed at a vicinity of the forwarding member and at upstream side to the forwarding member in the feeding direction of the documents.

6. The document feeding apparatus of claim 4, wherein the plurality of sensors include a plurality of size detecting sensors each of which is disposed at such a position that corresponds to a trailing edge of the documents having each one of various sizes; and wherein during the operation for sequentially forwarding each of the documents, the length of which are equal to or greater than the predetermined length, one by one, the controller controls the paper forwarding device so that the paper forwarding device forwards the next document after an operation for forwarding a current document has completed and the plurality of size detecting sensors detected the presence of the next document.

7. An image reading apparatus, comprising:

a document feeding tray to stack documents thereon;

a paper forwarding device to sequentially forward each of the documents one by one, in a conveying direction of the documents;

a document detector to detect a presence or absence of each of the documents stacked on the document feeding tray and a length of the documents in the conveying direction of the documents; and a controller to control the paper forwarding device;

wherein when determining that the length of the documents is equal to or greater than a predetermined length in the conveying direction of the documents, the controller controls the paper forwarding device so that the paper forwarding device starts an operation for feeding a next document after the controller has confirmed a fact that the document detector detected a presence of the next document on the document feeding tray; and wherein when determining that the length of the documents is smaller than the predetermined length, the controller controls the paper forwarding device so that the paper forwarding device starts the operation for feeding the next document before the controller confirms the fact that the document detector detects the presence of the next document on the document feeding tray.

8. The image reading apparatus of claim 7, wherein the document detector includes a plurality of sensors one of which is a document absence-or-presence sensor to detect the absence or presence of each of the documents on the document feeding tray; and wherein during an operation for sequentially forwarding each of the documents, the length of which are smaller than the predetermined length, one by one, the controller controls the paper forwarding device so that the paper forwarding device finalizes the operation for feeding the next document when the document absence-or-presence sensor detects the absence of the next document on the document feeding tray.

9. The image reading apparatus of claim 8, wherein the plurality of sensors include a plurality of size detecting sensors each of which is disposed at such a position that corresponds to a trailing edge of the documents having each one of various sizes; and wherein during the operation for sequentially forwarding each of the documents, the length of which are equal to or greater than the predetermined length, one by one, the controller controls the paper forwarding device so that the paper forwarding device forwards the next document after an operation for forwarding a current document has completed and the plurality of size detecting sensors detected the presence of the next document.

* * * * *